US008485177B2

(12) United States Patent
Feisthammel et al.

(10) Patent No.: US 8,485,177 B2
(45) **Date of Patent: *Jul. 16, 2013**

(54) DRIVE MECHANISM FOR A DOWN DRAFT VENT SYSTEM

(75) Inventors: Egon Feisthammel, Rastatt (DE); Petra Holzer, Karlsruhe (DE); Dieter Rosmann, Stuttgart (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/900,614

(22) Filed: Oct. 8, 2010

(65) Prior Publication Data

US 2011/0028082 A1 Feb. 3, 2011

Related U.S. Application Data

(63) Continuation of application No. 11/593,985, filed on Nov. 6, 2006, now Pat. No. 7,886,735.

(30) Foreign Application Priority Data

Nov. 18, 2005 (DE) ..... 10 2005 055 181

(51) Int. Cl.
*F24C 15/2092* (2006.01)
*F24C 15/2042* (2006.01)
*F24C 15/20* (2006.01)

(52) U.S. Cl.
USPC ..... 126/299 D; 126/299 R; 454/63; 454/64

(58) Field of Classification Search
USPC ..... 126/299 D, 299 R; 454/63, 64
See application file for complete search history.

(56) References Cited

U.S. PATENT DOCUMENTS

| | | | | |
|---|---|---|---|---|
| 1,215,573 | A | 2/1917 | Otis | |
| 2,568,808 | A * | 9/1951 | Johanson | 160/189 |
| 3,481,387 | A | 12/1969 | Purdy | |
| 3,694,664 | A | 9/1972 | Carli | |
| 3,719,005 | A | 3/1973 | Carli | |
| 3,821,927 | A | 7/1974 | Stratman et al. | |
| 4,010,408 | A | 3/1977 | Bailey | |
| 4,131,830 | A | 12/1978 | Lee et al. | |
| 4,446,849 | A | 5/1984 | McFarland | |
| 4,501,260 | A * | 2/1985 | Grace | 126/299 R |

(Continued)

FOREIGN PATENT DOCUMENTS

EP 0421719 A2 4/1991

*Primary Examiner* — Steven B McAllister
*Assistant Examiner* — Frances H Kamps
(74) *Attorney, Agent, or Firm* — James E. Howard; Andre Pallapies

(57) ABSTRACT

A drive mechanism for a down draft vent system comprising a vertically directed, retractable open framework, which can be moved between an extended position and a lowered position by means of a drive motor, comprising at least two switches for switching off the drive motor and at least one actuating element for actuating the switch. In this arrangement at least one switch is actuated by means of the at least one actuating element depending on a force ($F_W$) acting externally on the open framework. In addition to an end switch-off of the drive motor, this invention provides a safety function as a result of a resistive load switch-off which is effective both in the event of a resistance from below during retraction and also in the event of a resistance from above during extension of the open framework.

20 Claims, 4 Drawing Sheets

U.S. PATENT DOCUMENTS 4,945,891 A * 8/1990 Cecil ..... 126/299 D
5,062,410 A * 11/1991 Sarnosky et al. ..... 126/299 D
6,644,957 B2 * 11/2003 Weiss ..... 431/20
7,021,001 B1 * 4/2006 Schooler ..... 49/28
7,122,987 B2 10/2006 Chen
7,703,741 B2 * 4/2010 Mack ..... 251/129.04
2005/0248243 A1 11/2005 Bober
2007/0137635 A1 6/2007 Feisthammel et al.
2007/0137636 A1 * 6/2007 Mack ..... 126/299 D

* cited by examiner

DRIVE MECHANISM FOR A DOWN DRAFT VENT SYSTEM

CROSS-REFERENCE TO RELATED APPLICATION

This application is a continuation, under 35 U.S.C. §120, of U.S. application Ser. No. 11/593,985, filed Nov. 6, 2006; this application also claims the priority, under 35 U.S.C. §119, to German Application No. 10 2005 055 181.5, filed Nov. 18, 2005.

BACKGROUND OF THE INVENTION

The invention relates to a drive mechanism for a down draft vent system, in particular for a vertically directed, retractable down draft vent system, which can be moved between an extended position and a lowered position by means of a drive motor. The down draft vent system can be used with cookers or cooktops.

The down draft vent system which can be operated with the drive mechanism is a so-called cooktop ventilator which is also designated as a downdraft system. In these systems an open framework with a down draft inlet opening is arranged behind the cooktop. This open framework can be moved between a rest position and an operating position. In the rest position the open framework is retracted behind the cooktop and its upper side ends flush with the surface of the cooker. In the operating position, the open framework is driven out by a certain height from the surface of the cooker and the down draft inlet opening is thus located at a corresponding height above the cooktop.

Such a down draft vent system is described, for example, in DE 40 09 326 A1. In this down draft vent system the movement of the open framework is accomplished by means of a slider which is guided in a rail and by means of a helical cable which executes a longitudinal movement during a rotary movement of the drive motor. Provided at the ends of the rail in which the slider is guided are limit switches which switch off the drive motor on contact with the slider. The slider is not connected to the open framework but merely supports this at the bottom. During a vertical upward movement of the slider in the rail, the open framework is thus driven out above the surface of the cooker and on reaching the end position, that is the operating position, the drive motor is switched off by means of the upper limit switch. When the open framework is moved from the operating position, this is accomplished by a vertical downward movement of the slider in the rail. In this direction of movement, also the motor is switched off as soon as the end position, that is the rest position, was reached.

If an obstacle, for example, a pan is located between the upper edge of the open framework and the top of the cooker during the down movement of the open framework, the slider travels in the rail as far as its end position whereas the open framework which is guided independently of the rail, remains in a slightly elevated position until the obstacle is removed. After the obstacle has been removed, the open framework returns to the rest position as a result of its own weight.

The disadvantage with this drive mechanism is that when an obstacle occurs during extension of the open framework, if a pot for example is standing on the open framework, the open framework is nevertheless moved further and travels into its operating position.

BRIEF SUMMARY OF THE INVENTION

The object of the invention is to provide a drive mechanism whereby a vertically directed retractable down draft vent system can be operated reliably in a simple manner.

The object is achieved by a drive mechanism for a down draft vent system comprising a vertically directed, retractable open framework which can be moved by means of a drive motor between an extended and a lowered position, comprising at least two switches for switching off the drive motor and at least one actuating element for actuating the switch. The drive element is characterised in that at least one switch is actuated by means of the at least one actuating element depending on an externally acting force on the open framework.

An externally acting force in this context is understood as a force applied externally to the open framework, in addition to the weight prevailing at said framework or internally applied driving force.

In contrast to the driving system of the prior art, in which the switches are actuated depending on the position of the slider and thus only allows the drive motor to be switched off at the two end positions of the open framework, with the drive mechanism according to the invention, the switches can be actuated independently of the instantaneous position of the open framework. As a result, in addition to switching off the drive motor in the end position, that is switching off in the rest position and the operating position, a resistive load switch-off can also take place when an obstacle other than the end limits defining the rest position and the operating position is encountered.

This resistive load switch-off can, for example, stop the extension of the open framework when an obstacle is located on the open framework. Obstacles can also be taken into account in a simple manner when retracting the open framework since in this case, a force acts on the open framework. If such an upwardly directed force is present, the drive motor is switched off and the open framework is held in this position by the drive mechanism. After the obstacle, for example, a pan, has been removed, the drive motor is switched on again and the open framework is retracted into the rest position. In contrast to the prior art, a specific or guided retraction can also be achieved after removing the obstacle since the retraction is also effected by the drive mechanism after removing the obstacle and the open framework does not fall downwards into its rest position exclusively as a result of its own weight.

The drive mechanism preferably has two switches, the actuating element is mounted at a constant distance between the switches and a guide is provided for the relative movement of the actuating element between the switches.

In this case, the constant spacing between the actuating element and the two switches will exist during normal operation, that is when no obstacle occurs on the screen. A relative movement of the actuating element between the switches will only occur when an end position is reached or when another obstacle is encountered. The spacing between the two switches is kept low so that the switching distance is short. The advantage of this embodiment in which the actuating element is mounted between the switches at a constant spacing in normal operation and is only moved towards one of the switches when encountering an obstacle is that rapid switching behaviour can be ensured. In particular, compared with a drive mechanism according to the prior art, the arrangement and guidance of the actuating element has the advantage that the drive motor can be switched off not only at end positions but also in positions of the open framework located between the rest position and the operating position.

As a result of mounting the actuating element at a constant distance from the switches and a relative movement in a guide, a mechanical protection function can be implemented in the drive mechanism which can prevent jamming of objects between the open framework and the surface of the cooker or falling over and possible damage to an object placed accidentally on the open framework. Jamming of fingers during retraction or extension of the open framework can also be achieved particularly simply with this embodiment. In a drive mechanism according to the prior art comprising pure end switch-off, such a protection function must be implemented by electronic means.

The mounting of the actuating element preferably comprises at least one spring element. In this case, the actuating element can be connected to the spring element or abut against said element. The actuating element can be moved from its normal position, in particular from the position between the two switches, by means of the spring element as a result of a force acting on the actuating element and after the obstacle has been removed and the resistance force produced thereby, said actuating element can be returned to the normal position again. Depending on the embodiment, a tension spring or a compression spring is used as the spring element.

According to one embodiment of the invention, the switches for switching off the drive motor are affixed to the retractable open framework. This embodiment makes it possible to use a drive part such as a spindle nut, for example, to move the open framework with the switches attached thereto and at the same time, to move the actuating element. At the same time, mounting of a drive mechanism of this type is simplified. The assembly comprising the open framework and the switches can be completed during pre-assembly.

In the embodiment in which the switches are affixed to the open framework, the actuating element can be a sliding block with a contact arm which projects through a vertical recess in a guide of the sliding block. In this case, the sliding block is preferably held on the spindle nut but is not connected thereto. The contact arm projects over the sliding block in the radial direction of the spindle nut. This makes it possible to arrange the switches laterally spaced from the sliding block and its guide. The switches are actuated by means of the contact arm by providing a recess in the sliding block. In one embodiment in which the sliding block bears the screen by means of a compression spring, the recess can be selected to be so long that this projects beyond the length of the spring. The downward displacement path which is thus obtained for the sliding block provides addition protection against fingers being jammed during retraction of the open framework.

According to a further embodiment, the actuating element is brought into contact with the switches by a tilting movement. In this embodiment, the switches are preferably arranged offset with respect to one another in the horizontal and vertical direction. In this case, the actuating element can be horizontally aligned during normal operation, that is without the open framework encountering an obstacle, and can be pivoted about the central point when encountering an obstacle, so that one of the two ends of the actuating element comes in contact with a switch whilst the other end of the actuating element is remote from the switch which is actuated by said element. Such an actuating element, also designated as a rocker, is preferably provided outside the open framework and be pre-assembled as a compact component.

The actuating element can, for example, be a part of the mounting of the drive motor of the drive mechanism. In this case, the mounting is configured as a rocker arrangement holding at least a part of the drive motor. This embodiment has the advantage that the cable guide for connecting into the power circuit by which means the drive motor is supplied with the necessary power is short.

BRIEF DESCRIPTION OF THE DRAWINGS

The invention is explained in detail again hereinafter with reference to the appended drawings. In the figures.

DETAILED DESCRIPTION OF EXEMPLARY EMBODIMENTS OF THE PRESENT INVENTION

Figure 1:
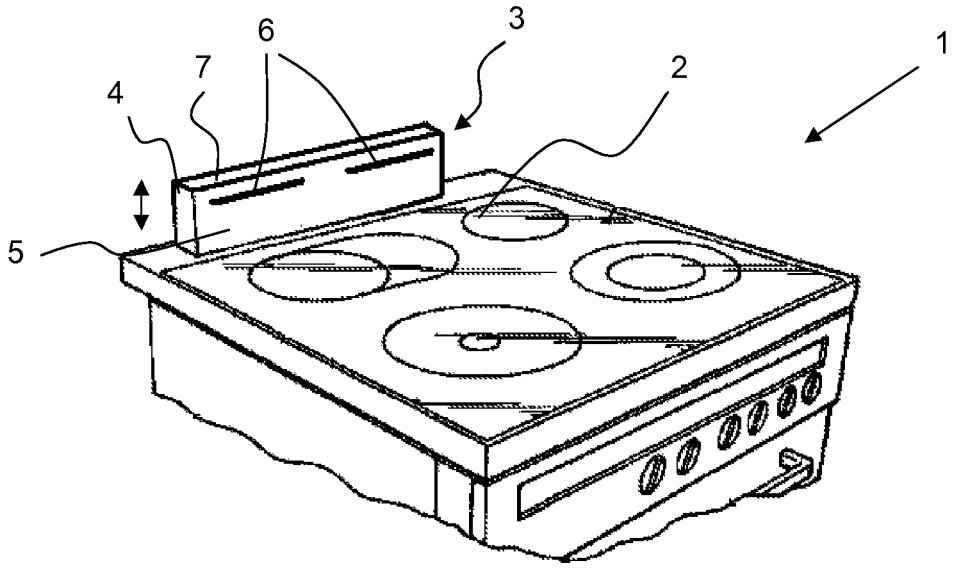
FIG. 1: is a schematic view of a cooker with down draft vent system.

FIG. 1 shows a cooker 1 with a cooking surface 2 on its upper side. In FIG. 1 only a part of the open framework 4 of the down draft vent system 3 can be seen from the down draft vent system 3. Said system has down draft inlet openings 6 on the front side 5, that is the side facing the cooking surface 2. Odours and steam produced during cooking on the cooking surface 2 are extracted and guided into the interior of the open framework 4 and removed from there. For this purpose, a fan and an air guidance system not shown in the Figure are provided in the open framework 6.

The open framework 4 is retractable and can be driven vertically from a lowered position in which the upper edge 7 usually ends flush with the surface of the cooker 1 into an extended or operating position in which the down draft inlet openings have the maximum distance from the surface of the cooker 1. This movement is indicated by the arrow in FIG. 1.

The drive of the open framework 4 is explained with reference to the exemplary embodiments shown in the Figures.

Figure 2:
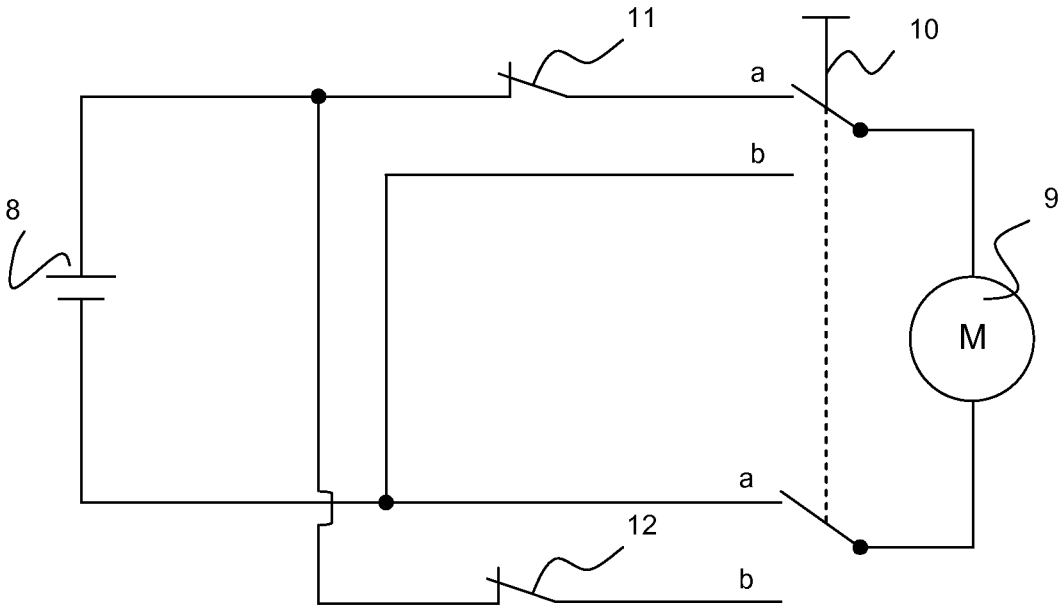
FIG. 2: is a schematic circuit diagram for the drive mechanism according to the invention.

FIG. 2 initially shows a schematic circuit diagram for the drive mechanism according to the invention. A drive motor 9, which can be a DC motor, is supplied with voltage by means of a voltage source 8. A two-way switch 10 is provided between the voltage source 8 and the drive motor 9 which can change the direction of rotation of the drive motor 9. In this case, switching takes place to and fro between the current path a for rotation in one direction and the current path b for rotation in the opposite direction. Another switch 11 which serves as an interrupt initiation switch or normally closed contact is interposed in the current path a. A switch 12 as an interrupt initiation switch or normally closed contact is also interposed in the current path b. The power supply to the drive motor 9 can thus be interrupted by means of the switches 11 and 12 and thereby switched off.

FIGS. 3 to 8 show the structure and principle of action of a first embodiment of the drive mechanism 13.

Figure 3:
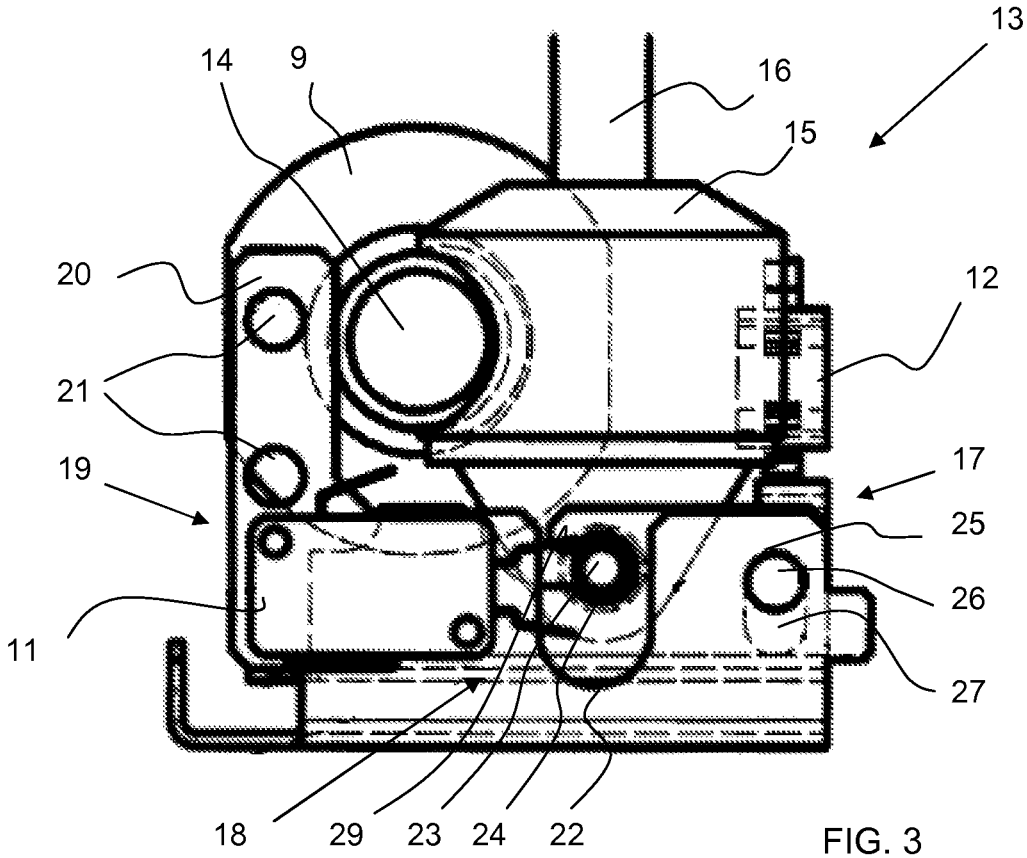
FIG. 3: is a side view of a first embodiment of the drive mechanism according to the invention.
Figure 4:
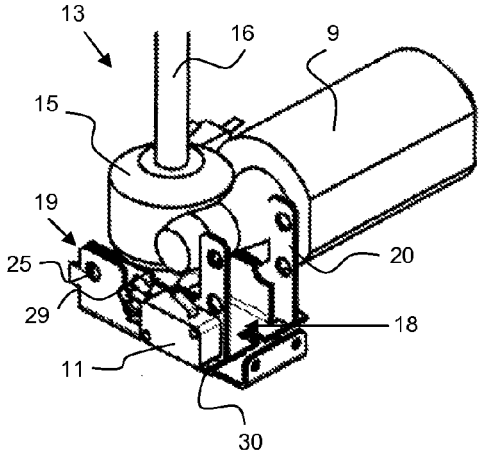
FIGS. 4 and 5: are schematic perspective views of the drive mechanism from FIG. 3.
Figure 5:
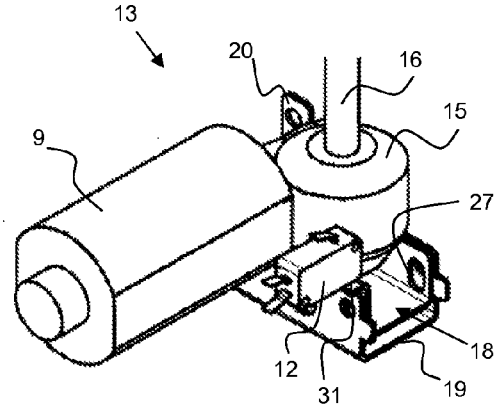

FIG. 3 shows a side view of the drive motor area and its mounting. FIGS. 4 and 5 show perspective views of the drive motor area from which some components of the drive mechanism can be better seen. The drive motor 9 is horizontally arranged and its drive shaft 14 projects laterally. The drive shaft 14 engages in a helical gear 15 which turns a vertically running spindle 16.

A spindle nut (not shown) is held on the spindle 16, by which means the open framework (not shown) can be driven upwards and/or downwards in the vertical direction.

The mounting 17 for the drive motor 9 consists of a rocker 18 which is held and mounted in a rocker receptacle 19. The rocker receptacle 19 is a U-profile with two retaining arms 20 which extend upwards at one end of the U-legs. The retaining arms 20 have openings 21 for a bolt (not shown) which extends between the two retaining arms 20. Provided on this bolt is a tension spring (not shown) which is connected to the rocker 18 and mounts the rocker 18 flexibly on one side from the top. The upper or the lower of the openings 21 for receiving the bolt in the retaining arms 20 is used depending on the length of the tension springs used.

In the central area of the length of the rocker receptacle 20, a recess 22 is provided in the legs of the U-profile which extends from the upper edge of the U-leg of the rocker receptacle 20 towards the base of the U-profile of the rocker receptacle. A guide bolt 23 is guided through this recess, extending through an opening 24 on the underside of the helical gear 15 as far as a corresponding recess 22 in the opposite leg of the U-profile of the rocker receptacle 20.

A hole 25 for a stop pin 26 is provided in the area of the right end of the rocker receptacle 20 in the diagram in FIG. 3. The stop pin 26 projects through vertically aligned elongated holes 27 in the legs of the rocker 18 which is also substantially a U-profile and extends as far as a further hole 25 in the opposite legs of the rocker receptacle 20. The rocker 18 is thus mounted at one end in the elongated hole 27 by means of the stop pin 26 and is mounted at the other end by means of the tension spring on the bolt in the retaining arms 20 of the rocker receptacle 19. At the centre, the rocker 18 has a horizontally aligned gripping arm 38 at the end whereof a downwardly projecting lug 29 is provided. The rocker 18 is held pivotally on the guide bolt 23 by the gripping arm 38 with the lug 29.

A first interrupt initiation switch 11 is arranged on the rocker receptacle 19 on one leg in the area underneath the retaining arm 20. The second interrupt initiation switch 12 is arranged on the opposite end of the rocker receptacle 19 at the side. The switches 11 and 12 are only shown schematically but can be screwed onto the rocker receptacle 19, for example. The switches 11 and 12 can additionally or alternatively rest on projections 30 on the rocker receptacle 19.

Figure 7:
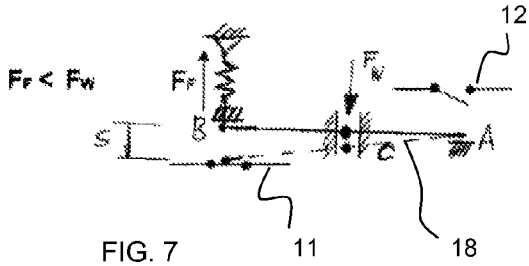
Figure 8:
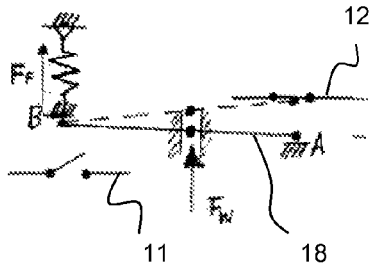

The operating mode of this drive mechanism 13 is explained with reference to the schematic diagrams in FIGS. 6 to 8. For a better understanding, the schematic diagrams merely show the rocker 18 and its mountings at points A, B and C as well as the interrupt initiation switches 11 and 12. Positions A, B and C correspond to the following positions in the embodiment shown in FIG. 3. The mounting in position A is formed by the stop pin in the hole 25 in the rocker receptacle 19 and the elongated hole 27 in the rocker 18. The mounting in position C is achieved by the guide bolt 24 in cooperation with the recess 22 in the rocker receptacle 19. The mounting in position B consists of the bolt which is held in the retaining arms 20 of the rocker receptacle 19 and the tension spring affixed thereto. This bolt which is held in the retaining arms 20 of the rocker receptacle 19 is schematically shown in FIGS. 6-8 as the feature that interconnects the respective end of the tension spring and the rocker 18 to one another.

Figure 6:
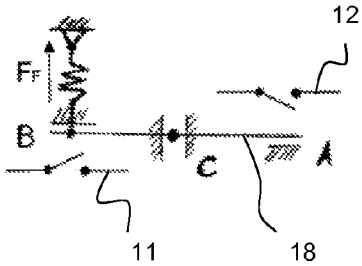
FIGS. 6, 7 and 8; are schematic diagrams of the first embodiment of the drive mechanism.

In FIG. 6 the rocker 18 is shown in the neutral position. The rocker 18 is located in this position when the open framework affixed to the spindle 16 is retracted and extended without encountering any obstacle or any resistance. The rocker 18 is located at a distance s from the two switches 11 and 12, which corresponds to the switching distance.

The rocker 18 is flexibly mounted from above at point B. Since this is a tension spring, the spring force $F_F$ is upwardly directed, However, the tension spring is relaxed in the neutral position of the rocker 18. The rocker 18 is thus prevented from actuating the first interrupt initiation switch 11 by the spring force $F_F$. The interrupt initiation switch 11 is a normally closed contact so that in the position shown, this allows power to be supplied to the drive motor, that is, does not interrupt. In position 18 the rocker is mounted at the bottom. In position C the rocker 18 is guided vertically. In the neutral position, the rocker 18 is flat.

During retraction and extension of the open framework however, said framework can encounter obstacles as a result of which a resistance force acts on the open framework. The obstacles can either be mechanical resistances such as sheet-metal angles or the like which mark the end positions of the open framework on the spindle or in the area of the spindle. Another obstacle during retraction and extension can also be a finger jammed between the open framework and another surface. Finally, further obstacles can be cooking utensils such as pots or pans placed on the open framework or jammed between the upper edge of the open framework and the surface of the cooker. Jamming during retraction of the open framework is particularly important when the upper edge of the open framework has a greater width than the open framework itself.

If the open framework is extended upwards driven by the drive motor 9 and encounters a resistance, a downwardly directed resistance force $F_W$ is transferred to the rocker by means of the spindle 16 and the guide bolt 23. The rocker 18 adopts the position shown in the schematic diagram in FIG. 7. As a result of the resistance force $F_W$ which is greater than the spring force $F_F$ acting thereon, the rocker 18 is deflected downwards at position B since this is mounted at the bottom at position A. In this position, the switch 11 actuated. This can be effected, for example, by means of the lug 29 on the gripping arm of the rocker 18. The drive motor 9 is thus switched off and the open framework stops. As a result of the spring mounting at position B, the open framework only comes to a standstill after overcoming the spring force $F_F$. As a result, lower resistances which would not justify switching off the drive motor can be overcome without the open framework coming to a standstill.

If the obstacle is removed, the rocker 18 is restored into the neutral position by the spring force $F_F$ of the tension spring. In the neutral position, the switch 11 is no longer actuated and thus the power supply to the drive motor is restored.

During retraction of the open framework, the rocker 18 again lies in the neutral position until the open framework encounter a resistance or an obstacle. If an obstacle is encountered from above, an upwardly directed resistance force is produced whereby the rocker 18 is deflected upwards at position A since the rocker 18 is mounted at the top in position B. In this position, the rocker 18 actuates the interrupt initiation switch 12 and the open framework is stopped. The switch 12 can be actuated by means of a bend 31 (see FIG. 5) on the rocker 18 which extends at one leg of the U-profile of the rocker 18 outwards beyond the rocker receptacle 19. This bend 31 can additionally contribute to the stop pin 26 for mounting the rocker 18 at position A.

If the obstacle is removed and thus the upwardly directed resistance force $F_w$ disappears, the rocker 18 is restored into the neutral position through the weight of the rocker 18 and the open framework mounted thereon. Lowering of the rocker 18 in position A also release the contact to the switch 12 and the drive motor 9 can again drive the spindle 16 and thereby retract the open framework. Interruption of the power supply to the drive motor 9 by actuating the switch 12 also serves as protection against finger jamming during retraction of the open framework.

Figure 10:
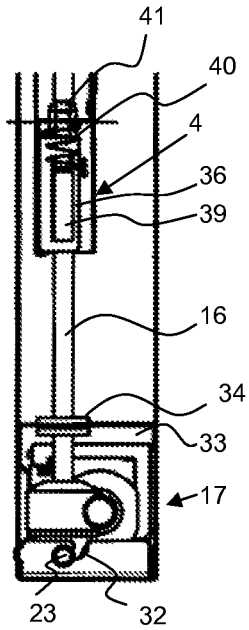
Figure 11:
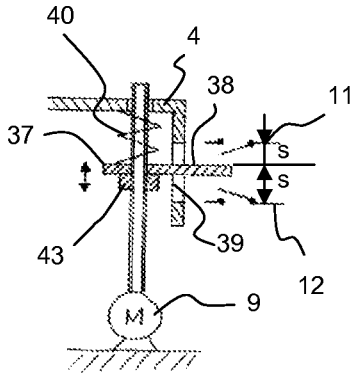
FIG. 11: is a schematic diagram of the second embodiment of the drive mechanism.

The invention can also be implemented in a different manner. For example, the arrangement shown in FIGS. 9 to 11 can be used. In this case, the structure of the drive motor 9, the gear 15 and the spindle 16 substantially corresponds to the structure described with reference to the first exemplary embodiment. However, in this case the motor mounting 17 is rigidly constructed. In this mounting a guide bolt 23 is inserted into a recess 32 in the mounting 17 and rigidly connects the mounting 17 and the gear 15.

The open framework 4 is guided on the spindle 16 above the motor mounting 17 which is accommodated in a housing 33. A bearing 34 through which the spindle 16 passes is attached at the top in the housing 33. A switch box 35 is affixed to the open framework 4 at a distance from the bearing 34. The switch box 35 extends horizontally inside the open framework 4. A sliding block guide 36 is provided along the axis of the spindle 16 in the switch box 35. A sliding block 37 is guided in the sliding-block guide 36, said sliding block having a contact arm 38 on one side which extends through an elongated vertical recess 39 in the sliding-block guide 36 in the switch box 35. A compression spring 40 held in a spring guide 41 is arranged above the sliding block 37. This spring guide 41 has a U-shape having locating lugs 42 at the free outer ends of the U-legs. The free outer ends of the legs are guided with the locating lugs 42 through a recess in the upper side of the switch box 35 and the locating lugs thus fix the spring guide 41 on the switch box and therefore on the open framework 4.

Underneath the sliding block 37, the spindle nut 43 abuts against the sliding block 37. The sliding block 37 and the compression spring 40 with the spring guide 41 can be moved along the spindle 16. In this way, the open framework 4 to which the switch box 35 is affixed, is flexibly mounted on the spindle nut 43 and can be moved upwards and downwards by the vertical movement of the spindle nut 43 along the spindle 16.

The switches 11 and 12 are fixed in the switch box 35 laterally offset with respect to the spindle 16. The switches 11 and 12 are arranged above one another in such a manner that the contact arm 38 of the sliding block 37 lies between said switches in the neutral position. The distance from the contact arm 38 to the switch 11 or 12 represents the respective switching distance s. By moving vertically, the contact arm 38 can come in contact with the switches 11 or 12 and can actuate these.

Figure 9:
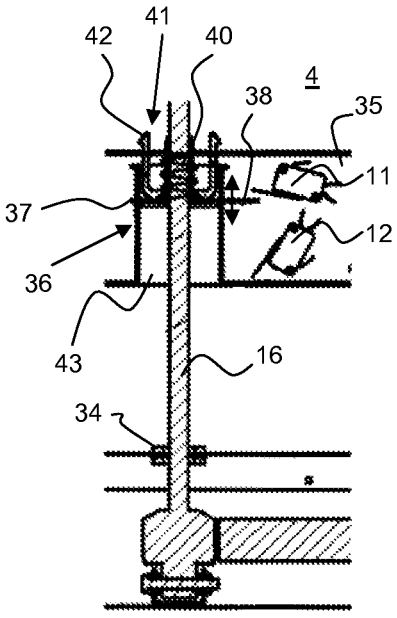
FIGS. 9 and 10; are a schematic section view and side view of a second embodiment of the drive mechanism according to the invention.

The operating mode of this embodiment is explained with reference to FIGS. 9 to [ . . . ]. In this embodiment the open framework 4 is extended by displacing the spindle nut 43 upwards by means of the spindle 16. The open framework 4 spring-mounted by means of the compression spring 40 is displaced as a result.

If the open framework encounters an object during an upward movement, that is during extension, the spindle nut 43 initially displaces the sliding block 37 further upwards. Since the open framework 4 cannot be deflected further upwards as a result of the resistance force acting on said framework from above, the sliding block 37 is pushed against the compression spring 40 supported on the open framework 4. The spring 40 is compressed and the sliding block 37 with the protruding contact arm 38 is pushed further upwards. As soon as the contact arm 38 projecting through the sliding block guide 36 comes in contact with the upper switch 11, the circuit to the drive motor 9 is thereby broken and the open framework 4 stops. When the obstacle is removed, the open framework 4 will move upwards as a result of the spring force and the contact of the contact arm 38 with the upper switch 11 is thereby lifted. The open framework 4 can thus be extended further.

If the open framework 4 encounters an object during retraction, in this embodiment the sliding block guide 36 is again entrained by the spindle nut 43 and moves downwards. The contact arm 38 of the sliding block 37 projects through the recess 39 in the guide 36. The spring 40 is relaxed and is held in position by the spring guide 41. As soon as the compression spring 40 is fully relaxed, during a further downward movement of the spindle nut 43, the sliding block 37 which is carried thereon moves away from the spring guide 41. From this time the open framework is no longer held by the spindle nut 43 and the sliding block 37 provided thereon. The sliding block 37 is entrained by the spindle nut 43 and is lowered until the contact arm 38 comes in contact with the switch 12 through the recess 39. In this state, the drive motor 9 is switched off. The travel of the sliding block 37 through the recess 39 in the guide 36 for the sliding block 37 made possible in this case at the same time serves as protection against finger jamming.

As soon as the obstacle is removed, the open framework 4 can be lowered again and the spring guide 41 comes in contact with the sliding block 37. In this position, the contact arm 38 is at a distance from the switch 12 and the drive motor 9 is operating again so that the open framework 4 can be retracted.

The present invention thus provides an inexpensive and simple realisation of a drive mechanism wherein the number of individual components is minimised. In the present invention, two switches are sufficient to achieve end switch-off of the drive motor and also a resistive load switch-off at the same time. In drive mechanisms, a switch to be provided separately had to be used for switching off the resistive load. In addition, the drive mechanism according to the invention can be easily mounted since this has a compact design, for example as a rocker or as a switch box with sliding block guide. In addition, the assembly of the drive mechanism can be pre-assembled and installed in the down draft vent system in the completed state. Also, the drive mechanism can easily be repaired since the switches are actuated exclusively by mechanical means which can be replaced or repaired. Since no electronic control is required for switching off the motor in the present invention, the mechanism can be used universally, especially in appliances in which electronics cannot be integrated. The mechanism also has a small overall size.

An important advantage of the invention however is that the drive mechanism has a safety function as a result of a resistive load switch-off which is effective both in the event of a resistance from below during retraction and also in the event of a resistance from above during extension of the open framework.

What is claimed is:

1. A drive control mechanism for a vertically retractable down draft vent system, the drive control mechanism comprising:

a first switch that interrupts a drive circuit that supplies power to a drive motor, the first switch interrupting the drive circuit when a framework of the vent system encounters a downwardly directed force equal to or greater than a threshold force;

a second switch that interrupts the drive circuit when the framework of the vent system encounters an upwardly directed force equal to or greater than the threshold force; and an actuating element that is connected to the framework, the actuating element moving in response to the downwardly directed force equal to or greater than the threshold force to actuate the first switch to interrupt the drive circuit when the framework reaches a fully extended position, and the actuating element moving in response to the upwardly directed force equal to or greater than the threshold force to actuate the second switch to interrupt the drive circuit when the framework reaches a fully retracted position, wherein the actuating element is positioned in a non-contact position when the framework encounters no downwardly directed force or a downwardly directed force less than the threshold force and the framework encounters no upwardly directed force or an upwardly directed force less than the threshold force, the first switch does not interrupt the drive circuit when the actuating element is in the non-contact position, the second switch does not interrupt the drive circuit when the actuating element is in the non-contact position, the first or second switch continues to interrupt the drive circuit while the framework encounters a force equal to or greater than the threshold force, and when the actuating element returns to the non-contact position from a position in which the first or second switch interrupted the drive circuit, the drive circuit is completed and the drive motor operates in a direction in which it was operating before the drive circuit was interrupted by the first or second switch.

2. The drive control mechanism according to claim 1, wherein the actuating element actuates the first and second switches by being brought into contact with the switches by a tilting movement of the actuating element.

3. The drive control mechanism according to claim 2, wherein the actuating element is a part of a mounting structure of the drive motor to a stationary portion of the down draft vent system.

4. The drive control mechanism according to claim 3, further comprising a shaft for mounting the actuating element to the stationary portion, wherein the actuating element pivots about the shaft.

5. The drive control mechanism according to claim 4, further comprising a spring element for connecting the actuating element to the stationary portion, a force provided by the spring element being overcome by the downwardly directed force equal to or greater than a threshold force or the upwardly directed force equal to or greater than a threshold force when the first switch or the second switch is activated to interrupt the drive circuit.

6. The drive control mechanism according to claim 5, wherein the spring element is located at one end of the actuating element, and another end of the actuating element is for movably attaching to the stationary portion by a pin that is located in a slot in the stationary portion.

7. The drive control mechanism according to claim 1, wherein the actuating element is mounted at a constant distance (s) between the first and second switches when the actuating element is in a rest position in which the framework encounters no downwardly directed force and no upwardly directed force.

8. The drive control mechanism according to claim 1, wherein the actuating element is a contact arm that moves vertically with the framework.

9. The drive control mechanism according to claim 8, further comprising a spring element for positioning between the contact arm and the framework such that the spring element allows relative movement between the contact arm and the framework.

10. The drive control mechanism according to claim 9, wherein the spring element allows relative movement between the contact arm and the framework when the framework encounters the downwardly directed force equal to or greater than the threshold force, and the spring element allows relative movement between the contact arm and the framework when the framework encounters the upwardly directed force equal to or greater than the threshold force.

11. The drive control mechanism according to claim 10, wherein contact between the contact arm and a contact surface of the framework causes the contact arm come into contact with and actuate the first switch or the second switch.

12. The drive control mechanism according to claim 8, wherein the first and second switches are fixed to the framework.

13. A vertically retractable down draft vent system, comprising:

a framework;

a drive motor that moves the framework;

a drive circuit that supplies power to the drive motor; and a drive control mechanism having a first switch that interrupts the drive circuit when the framework encounters a downwardly directed force equal to or greater than a threshold force;

a second switch that interrupts the drive circuit when the framework encounters an upwardly directed force equal to or greater than the threshold force; and an actuating element that is connected to the framework, the actuating element moving in response to the downwardly directed force equal to or greater than the threshold force to actuate the first switch to interrupt the drive circuit when the framework reaches a fully extended position, and the actuating element moving in response to the upwardly directed force equal to or greater than the threshold force to actuate the second switch to interrupt the drive circuit when the framework reaches a fully retracted position, wherein the actuating element is positioned in a non-contact position when the framework encounters no downwardly directed force or a downwardly directed force less than the threshold force and the framework encounters no upwardly directed force or an upwardly directed force less than the threshold force, the first switch does not interrupt the drive circuit when the actuating element is in the non-contact position, the second switch does not interrupt the drive circuit when the actuating element is in the non-contact position, the first or second switch continues to interrupt the drive circuit while the framework encounters a force equal to or greater than the threshold force, and when the actuating element returns to the non-contact position from a position in which the first or second switch interrupted the drive circuit, the drive circuit is completed and the drive motor operates in a direction in which it was operating before the drive circuit was interrupted by the first or second switch.

14. The system according to claim 13, wherein the actuating element actuates the first and second switches by being brought into contact with the switches by a tilting movement of the actuating element.

15. The system according to claim 14, wherein the actuating element is a part of a mounting structure of the drive motor to a stationary portion of the down draft vent system.

16. The system according to claim 13, wherein the actuating element is mounted at a constant distance (s) between the first and second switches when the actuating element is in a rest position in which the framework encounters no downwardly directed force and no upwardly directed force.

17. A cooking unit, comprising:

a heating element;

a vertically retractable down draft vent system having a framework;

a drive motor that moves the framework;

a drive circuit that supplies power to the drive motor; and a drive control mechanism having a first switch that interrupts the drive circuit when the framework encounters a downwardly directed force equal to or greater than a threshold force;

a second switch that interrupts the drive circuit when the framework encounters an upwardly directed force equal to or greater than the threshold force; and an actuating element that is connected to the framework, the actuating element moving in response to the downwardly directed force equal to or greater than the threshold force to actuate the first switch to interrupt the drive circuit when the framework reaches a fully extended position, and the actuating element moving in response to the upwardly directed force equal to or greater than the threshold force to actuate the second switch to interrupt the drive circuit when the framework reaches a fully retracted position, wherein the actuating element is positioned in a non-contact position when the framework encounters no downwardly directed force or a downwardly directed force less than the threshold force and the framework encounters no upwardly directed force or an upwardly directed force less than the threshold force, the first switch does not interrupt the drive circuit when the actuating element is in the non-contact position, the second switch does not interrupt the drive circuit when the actuating element is in the non-contact position, the first or second switch continues to interrupt the drive circuit while the framework encounters a force equal to or greater than the threshold force, and when the actuating element returns to the non-contact position from a position in which the first or second switch interrupted the drive circuit, the drive circuit is completed and the drive motor operates in a direction in which it was operating before the drive circuit was interrupted by the first or second switch.

18. The cooking unit according to claim 17, wherein the actuating element actuates the first and second switches by being brought into contact with the switches by a tilting movement of the actuating element.

19. The cooking unit according to claim 18, wherein the actuating element is a part of a mounting structure of the drive motor to a stationary portion of the down draft vent system.

20. The cooking unit according to claim 17, wherein the actuating element is mounted at a constant distance (s) between the first and second switches when the actuating element is in a rest position in which the framework encounters no downwardly directed force and no upwardly directed force.

* * * * *